US005375790A

United States Patent [19]

Svanqvist

[11] Patent Number: 5,375,790

[45] Date of Patent: Dec. 27, 1994

[54] REEL-UP WITH CENTRAL DRIVEN REELING DRUM

[75] Inventor: Tord O. S. Svanqvist, Karlstad, Sweden

[73] Assignee: Valmet-Karlstad AB, Karlstad, Sweden

[21] Appl. No.: 945,732

[22] Filed: Sep. 16, 1992

[30] Foreign Application Priority Data

Sep. 18, 1991 [SE] Sweden ..... 9102704-5

[51] Int. Cl.[5] ..... B65H 18/10; B65H 18/16

[52] U.S. Cl. ..... 242/541.1; 242/541.4; 242/542.3; 242/545

[58] Field of Search ..... 242/65, 541.1, 541.4, 242/541.7, 542.3, 545, 546

[56] References Cited

U.S. PATENT DOCUMENTS

| | | | |
|---|---|---|---|
| 2,176,198 | 10/1939 | Berry | 242/65 |
| 3,116,031 | 12/1963 | Moore et al. | 242/65 |
| 3,194,508 | 7/1965 | Netze | 242/58.3 |
| 3,250,483 | 5/1966 | Printz et al. | 242/65 |
| 3,433,429 | 3/1969 | Schnitzspahn | 242/65 |
| 3,743,199 | 7/1973 | Karr et al. | 242/65 |
| 3,857,524 | 12/1974 | Melead et al. | 242/56 R |
| 3,889,892 | 6/1975 | Melead | 242/65 |
| 4,049,212 | 9/1977 | Yamaguchi et al. | 242/65 |
| 4,165,842 | 8/1979 | Mengel | 242/58.3 |
| 4,179,330 | 12/1979 | Page | 242/65 |
| 4,711,404 | 12/1987 | Falk | 242/65 |
| 4,721,266 | 1/1988 | Haapanen et al. | 242/56 R |
| 4,778,122 | 10/1988 | Snygg | 242/65 |
| 4,905,925 | 3/1990 | Kremar | 242/65 |
| 4,934,619 | 6/1990 | Snygg | 242/65 |
| 5,069,394 | 12/1991 | Panttila et al. | 242/67.1 R |

FOREIGN PATENT DOCUMENTS

| | | | |
|---|---|---|---|
| 330169 | of 0000 | European Pat. Off. . | |
| 350212 | 1/1990 | European Pat. Off. . | |
| 1225014 | 9/1966 | Germany . | |
| 447816 | 12/1986 | Sweden . | |
| 459656 | 7/1989 | Sweden . | |
| 2900197 | 2/1990 | Sweden . | |
| 461976 | 4/1990 | Sweden . | |
| 2168040 | 6/1986 | United Kingdom | 242/65 |
| WO 90/00511 | 1/1990 | WIPO . | |
| WO 91/16257 | 10/1991 | WIPO . | |

*Primary Examiner*—Joseph J. Hail, III
*Assistant Examiner*—John Q. Nguyen
*Attorney, Agent, or Firm*—Bell, Seltzer, Park & Gibson

[57] ABSTRACT

The reel-up has a surface winding drum; two rails to support the reeling drum over which the web runs; secondary carriages movable linearly along the rails and provided with press devices to press against the reeling drum to maintain a linear pressure between the surface winding drum and the paper reel as it increases in size; and drive motor for central driving of the reeling drum. The central drive motor is mounted to one of the secondary carriages to be moved together with this, and positioning devices are disposed on the secondary carriages to abut against the reeling drum in order, together with the press devices, to fix the reeling drum so that its axis of rotation coincides with that of the coupling device of the central drive motor. Further, the central drive motor is axially movable on the secondary carriage in relation to the reeling drum to bring the coupling device of the central drive motor into engagement with the opposite coupling device of the reeling drum.

9 Claims, 7 Drawing Sheets

REEL-UP WITH CENTRAL DRIVEN REELING DRUM

FIELD AND BACKGROUND OF THE INVENTION

The present invention relates to a reel-up in a paper machine in which paper is manufactured in a continuous web reeled onto reeling drums in the reel-up to produce paper reels, the end portions of each reeling drum being provided with a bearing housing and a braking drum with coupling device.

The reel-up commonly used comprises a stand; a driven surface winding means rotatably journalled in the stand, said web running over said surface winding means; two parallel rails mounted in the stand to support the reeling drum at its bearing housing; a secondary system movable linearly along the rails and provided in the vicinity of each rail with a linearly movable secondary body, actuators for synchronous movement of the secondary bodies, and press devices disposed on the secondary bodies to press against the bearing housings of the reeling drum in order to maintain a predetermined linear pressure in the nip between the surface winding means and the paper reel as it increases in size; and drive means for central driving of the reeling drum, said drive means comprising a rotating coupling device for coaxial connection to one of the coupling devices of the reeling drum during its rotation.

The technique described above with central driving of the reeling drum around which the paper web is wound is the result of an increasing demand for paper with uniform properties. This increasing demand applies particularly to soft paper such as tissue and similar paper for sanitary purposes for which uniform density and permeability from the innermost to the outermost layer of the reel of paper is of the utmost importance. Central driving enables variation of the linear pressure over a larger interval so that compression of the paper web in the nip between the surface winding drum and the paper reel can be reduced.

In secondary systems consisting of pivotable secondary arms with press devices in the form of rotatable rollers, the point of contact of each roller with the reeling drum generates an arc shaped path when the secondary arm is pivoted in order to adjust the reeling drum as the diameter of the paper reel increases. This changing contact point for the rollers results in uneven linear pressure during winding. Furthermore, the secondary arms can only reach a certain distance which means that the finished paper reel cannot be made larger than is permitted by the range of the arms. Drum reels-up with secondary arms are described, for instance, in the following patent specifications: EP-0 350 212, U.S. Pat. No. 3,743,199, U.S. Pat. No. 889,892, U.S. Pat. No. 3,857,524, U.S. Pat. No. 4,778,122, SE-447 816 and SE-461 976.

These problems with secondary arms are overcome by a secondary system having linearly movable secondary bodies supporting the press devices. However, as the paper reel increases in size, slipping may occur between the surface winding drum and the paper reel. Drum reels-up with linearly movable secondary bodies are described, for instance, in the following patent specifications: DE-1 225 014, U.S. Pat. No. 3,116,031 and U.S. Pat. No. 3,250,483. The last-mentioned problem is eliminated by combining the linear secondary system with said central driving. The central driving is described, for instance, in the following patent specifications: SE-9000538-0, EP-0 330 169 and U.S. Pat. No. 4,179,330.

However, it has not been possible to utilize the advantages of central driving due to difficulties in aligning and coupling together the central driving and the reeling drum during operation. A contributory cause of these difficulties is that the drive means for the central driving is arranged on a special stand at the one side of the drum reel-up and, when in inoperative position, is entirely separated from the secondary system in order to be moved linearly by its own actuator. As will be understood, the special stand with the central drive means also requires a considerable amount of space.

SUMMARY OF THE INVENTION

The object of the present invention is to eliminate the problems mentioned above and provide a reel-up that ensures accurate setting of the central drive means and a reeling drum in relation to each other so that their cooperating coupling devices are coaxial prior to their being coupled together.

The present invention refers to a reel-up in a paper machine in which paper is manufactured in a continuous web reeled onto reeling drums in the reel-up to produce paper reels, the end portions of each reeling drum being provided with a bearing housing and a braking drum with coupling device, said reel-up comprising a stand; a driven surface winding means rotatably journalled in the stand, said web running over said surface winding means; two parallel rails mounted in the stand to support the reeling drum at its bearing housing; a secondary system movable linearly along the rails and provided in the vicinity of each rail with a linearly movable secondary body, actuators for synchronous movement of the secondary bodies, and press devices disposed on the secondary bodies to press against the bearing housings of the reeling drum in order to maintain a predetermined linear pressure in the nip between the surface winding means and the paper reel as it increases in size; and drive means for central driving of the reeling drum, said central drive means comprising a rotating coupling device for coaxial connection to one of the coupling devices of the reeling drum during its rotation, and said central drive means being mounted to one of the secondary bodies to be moved together with the secondary body, said secondary bodies having positioning means to abut in operative position against the bearing housings of said reeling drum on the side facing the surface winding means in order, together with the press devices, to fix the reeling drum so that its axis of rotation coincides with the axis of rotation of the coupling device of said central drive means, and said central drive means further being axially movable on said secondary body in relation to said reeling drum in order, when said two axes of rotation coincide during operation, to bring the coupling device of said central drive means into engagement with the opposite coupling device of said reeling drum.

The invention is described hereinafter in more detail with reference to the accompanying drawings.

DESCRIPTION OF PREFERRED EMBODIMENTS

Figure 1:
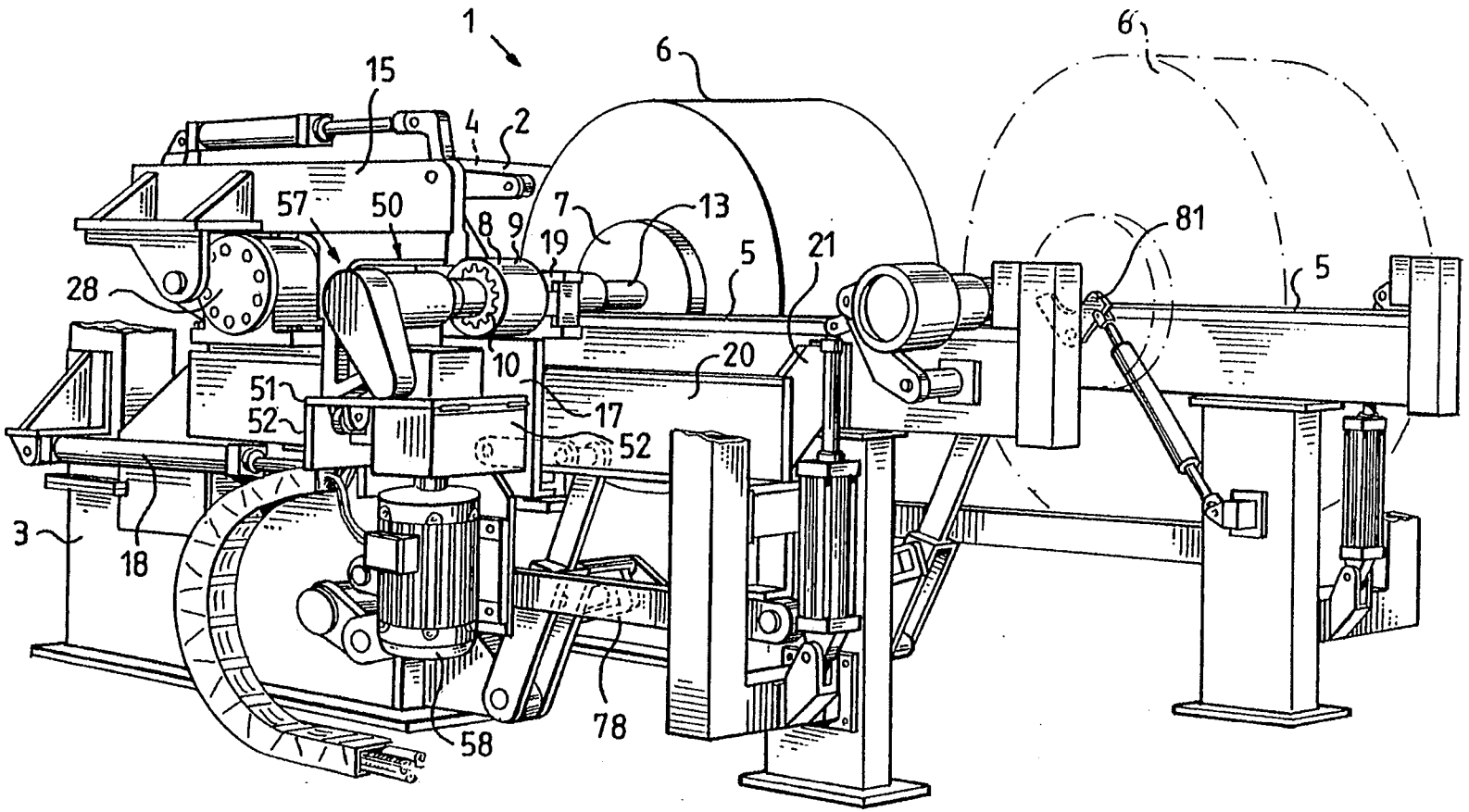
FIGS. 1 and 2 are different perspective views of parts of a drum reel-up according to the invention.
Figure 2:
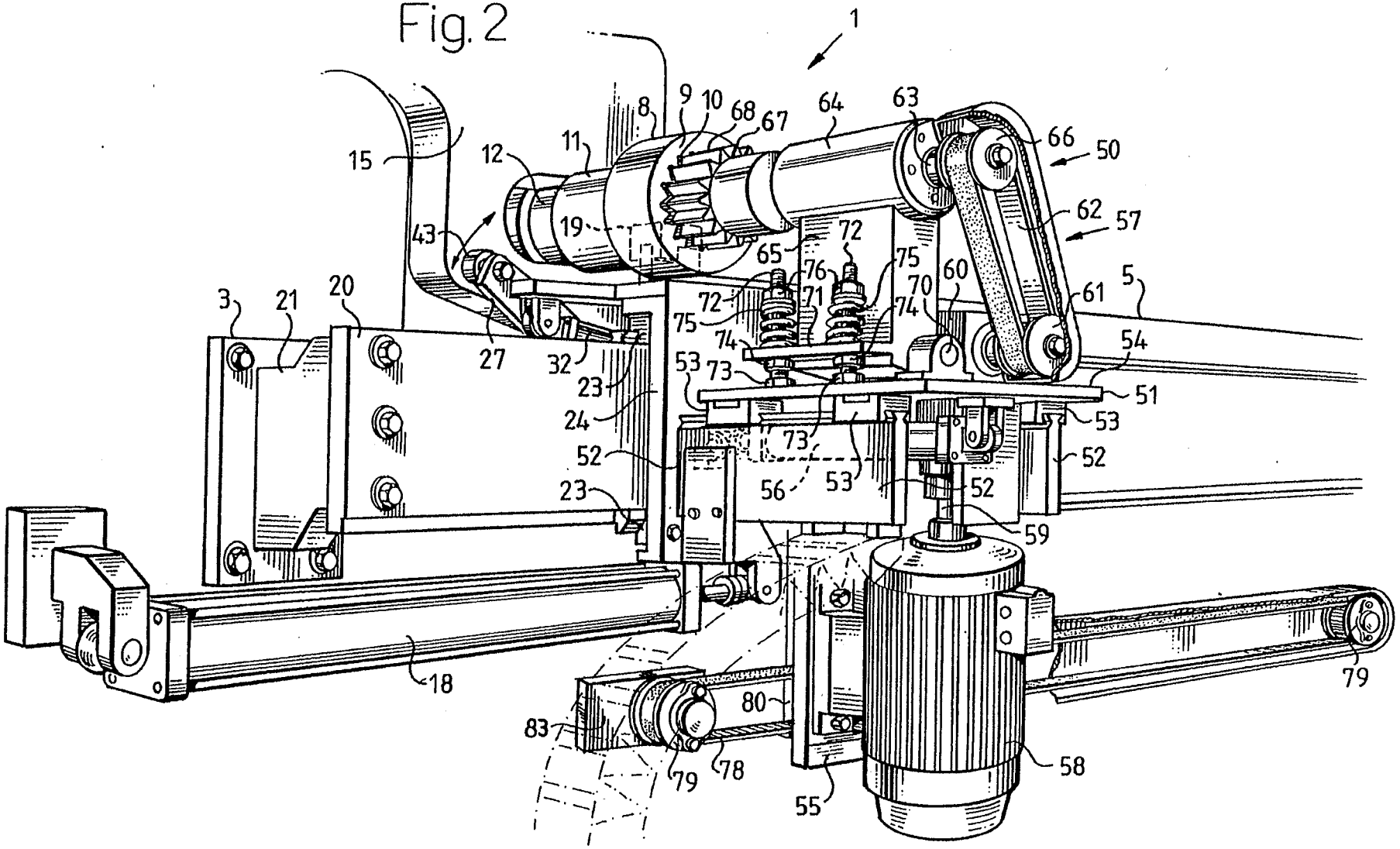
Figure 3:
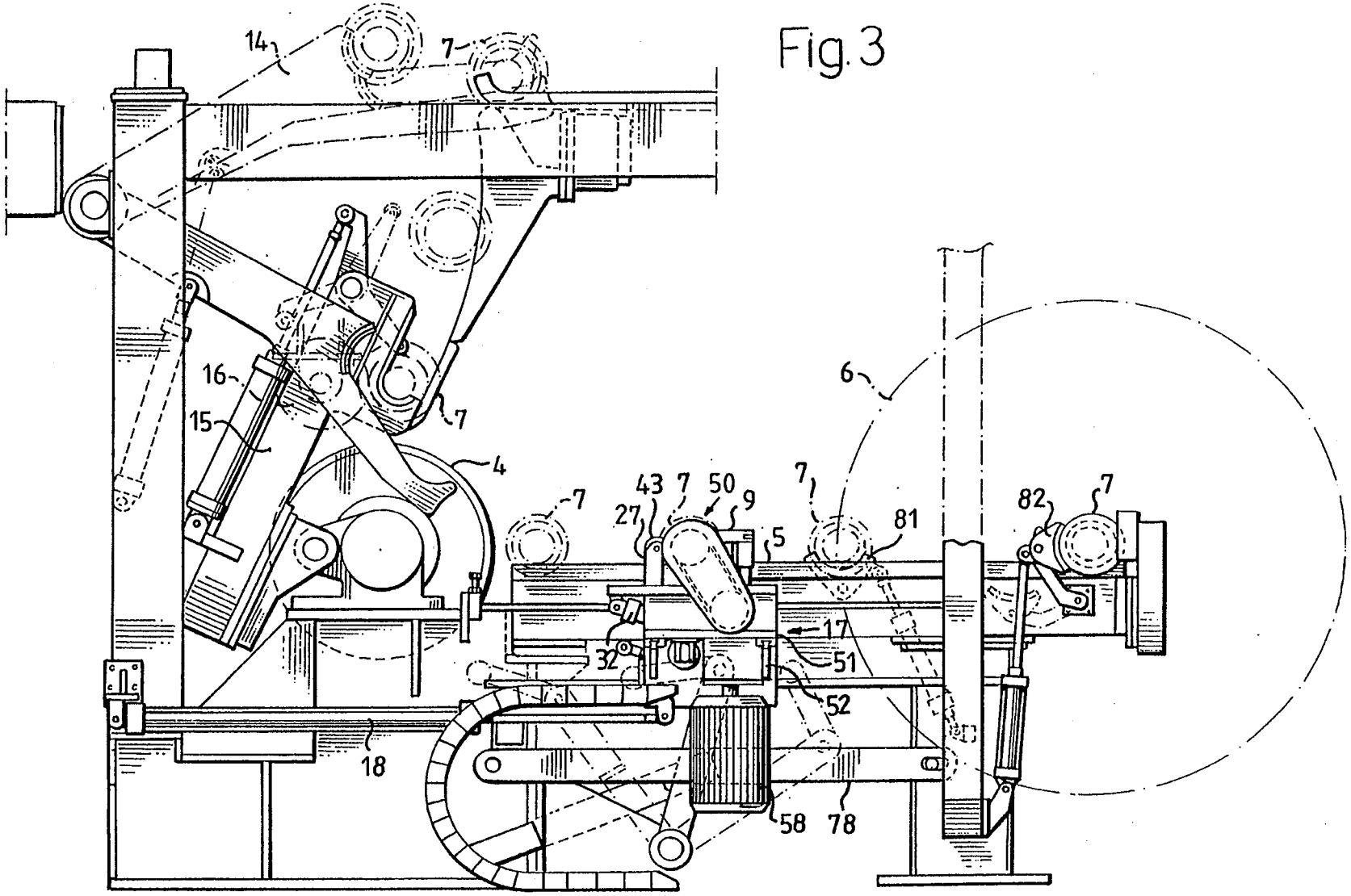
FIG. 3 is a side view of the drum reel-up according to FIG. 1.

FIGS. 1 and 2 show schematically in perspective parts of a drum reel-up 1 in a paper machine in which paper is manufactured in a continuous web 2. The drum reel-up has a stand 3 and a surface winding drum 4 rotatably journalled on the stand, said surface winding drum being driven by a motor 28 so that the surface winding drum acquires a peripheral velocity corresponding to the speed at which the paper web 2 is fed forwards. The drum reel-up also includes two horizontal rails 5, disposed parallel to each other and rigidly mounted to the stand 3 at a distance from each other slightly exceeding the width of the paper web 2.

Paper reels 6 are formed in the drum reel-up 1 about a core in the form of a reeling drum 7 supported by the rails 5. The reeling drum 7 is provided at each end with a braking drum 8 comprising a coupling device 9 with internal toothed rim 10, and a bearing housing 11 located axially inside the braking drum 8 and provided with a peripheral circumferential groove 12 for cooperation with the relevant rail 5. The bearing housing 11 enables the shaft 13 of the reeling drum, and the two coupling devices 9 located at the ends thereof to rotate as a unit together with the growing paper reel 6 while the bearing housings 11 roll along the rails 5 in the direction away from the driving surface winding drum 4.

Above the surface winding drum 4 is a store of empty reeling drums 7 and an arrangement for lowering an empty reeling drum 7 for cooperation with the surface winding drum 4 when a paper reel 6 approaches its full size. Said arrangement comprises lowering arms 14 and primary arms 15 which receive the reeling drum 7 from the lowering arms 14 so that the bearing housings 11 of the reeling drum 7 rest on the primary arms 15. The reeling drum 7 is retained by the primary arms 15 in a first position a distance above the surface winding drum 4. A motor driven starting device 16 is mounted on one side of the drum reel-up 1 to cause the empty reeling drum 7 to rotate with the same peripheral velocity as the surface winding drum 4 in order to avoid friction when the empty reeling drum 7 is subsequently lowered by said primary arms 15 and, in a second position, brought into contact with and driven by the surface winding drum 4. In this second position of the reeling drum 7 the paper web is transferred in suitable manner by suitable means (not shown) to the empty rotating reeling drum 7. The reeling drum is then lowered by said primary arms 15 to the rails 5 where it is supported by the rails. The primary arms 15 return to their initial position to await the next change of reeling drum 7 when the paper reel 6 has increased sufficiently in diameter so that the primary arms 15 are no longer in contact with the reeling drum 7.

Figure 7:
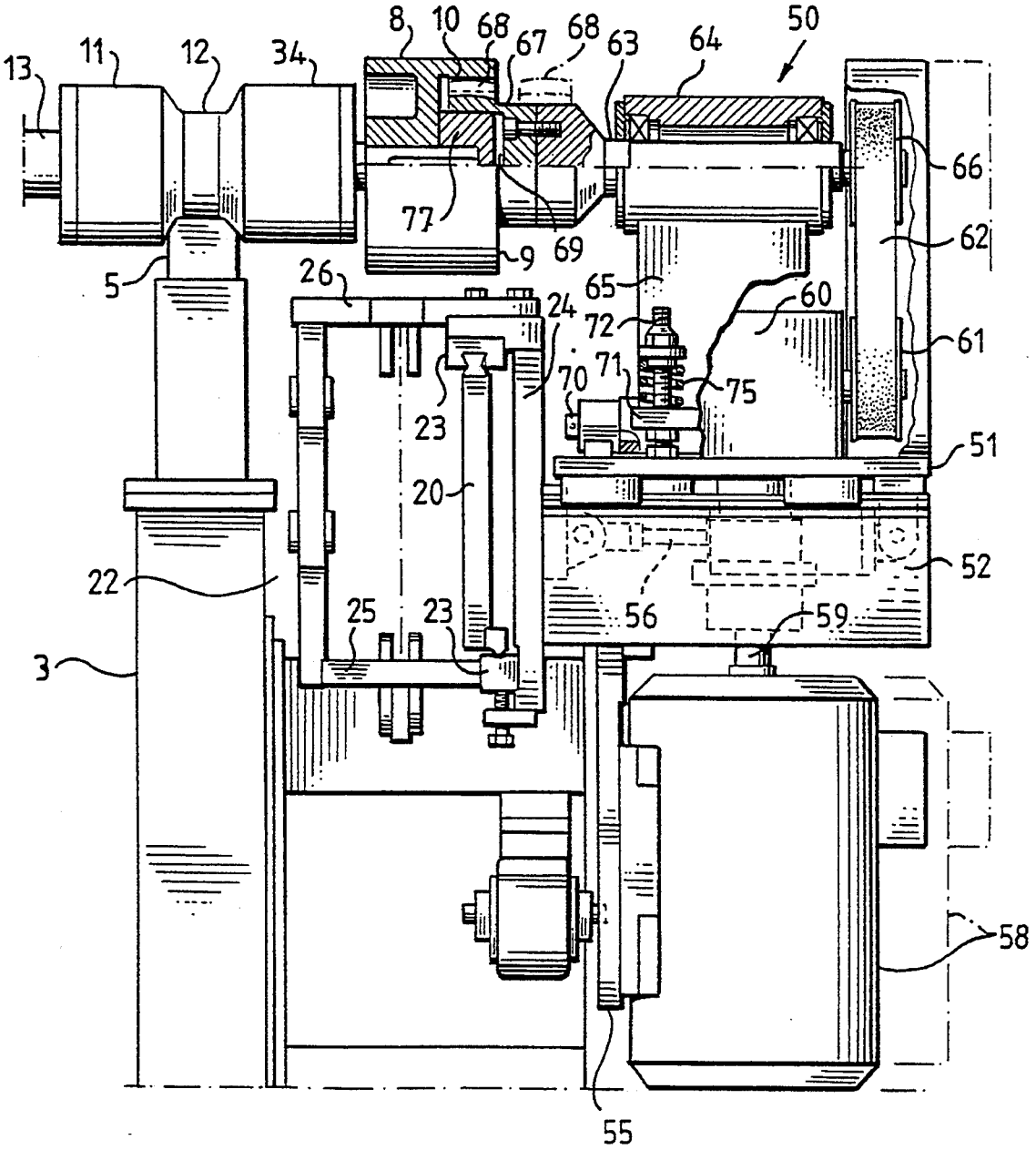
FIG. 7 is a view of the secondary system and a central drive means seen across the stand.

The drum reel-up 1 comprises a linearly movable secondary system, arranged near the rails to cooperate with the reeling drum 7 while the paper reel 6 is increasing in size. The secondary system comprises a linearly movable secondary body 17 disposed in the vicinity of each rail 5, two actuators 18 to effect movement of the secondary bodies 17, and two press devices 19 arranged on the secondary bodies 17 to press against the bearing housings 11 of the reeling drum 7 so that a predetermined linear pressure is maintained in the nip between the surface winding drum 4 and the paper reel 6 as it increases in diameter. In the embodiment shown each secondary body 17 consists of a secondary carriage or sledge which is movable along and parallel to the appropriate rail 5. Each secondary carriage 17 is supported by a beam 20 firmly secured by brackets 21 to the outside of the stand 3 in the vicinity of the rail 5 so that a space 22 (see FIG. 7) is formed between the stand 3 and the beam 20. As can be seen more clearly in FIG. 7, the secondary carriage 17 is journalled on the beam 20 by means of linear upper and lower journalling elements 23 comprising roller bearings in order to achieve the least possible friction. The secondary carriage 17 has an outer, vertical side plate 24, a horizontal bottom plate 25 and a horizontal top plate 26. Said actuator 18 of each secondary carriage 17 consists of a cylinder (hydraulic or pneumatic) which is secured by one end to the stand 3 and by the other end to the secondary carriage 17 in order to move the secondary carriage 17 along the beam 20. The movements of the secondary carriages 17 are synchronized with each other.

Figure 4:
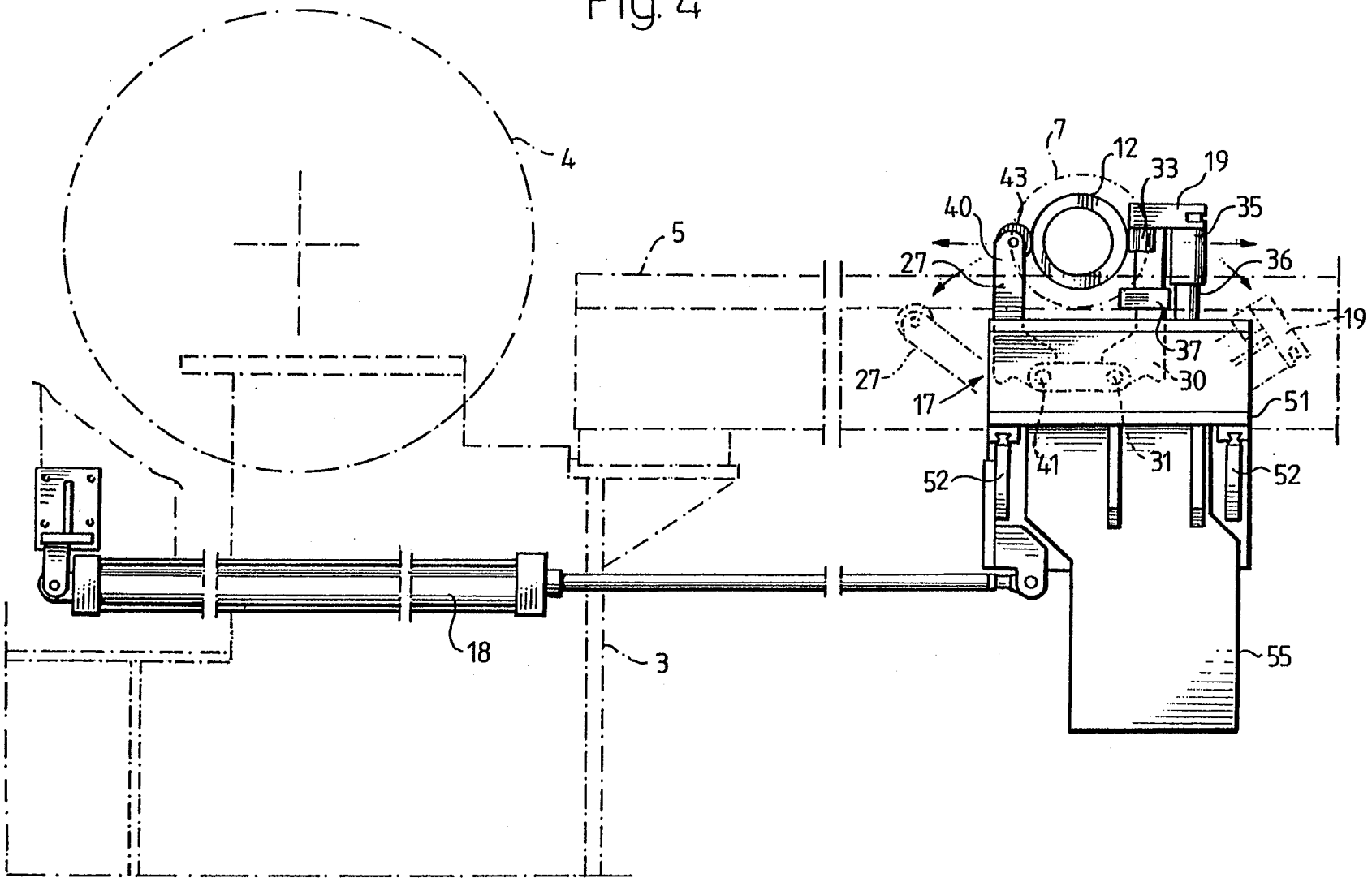
FIG. 4 is a side view of parts of the secondary system of the drum reel-up according to FIG. 1.
Figure 5:
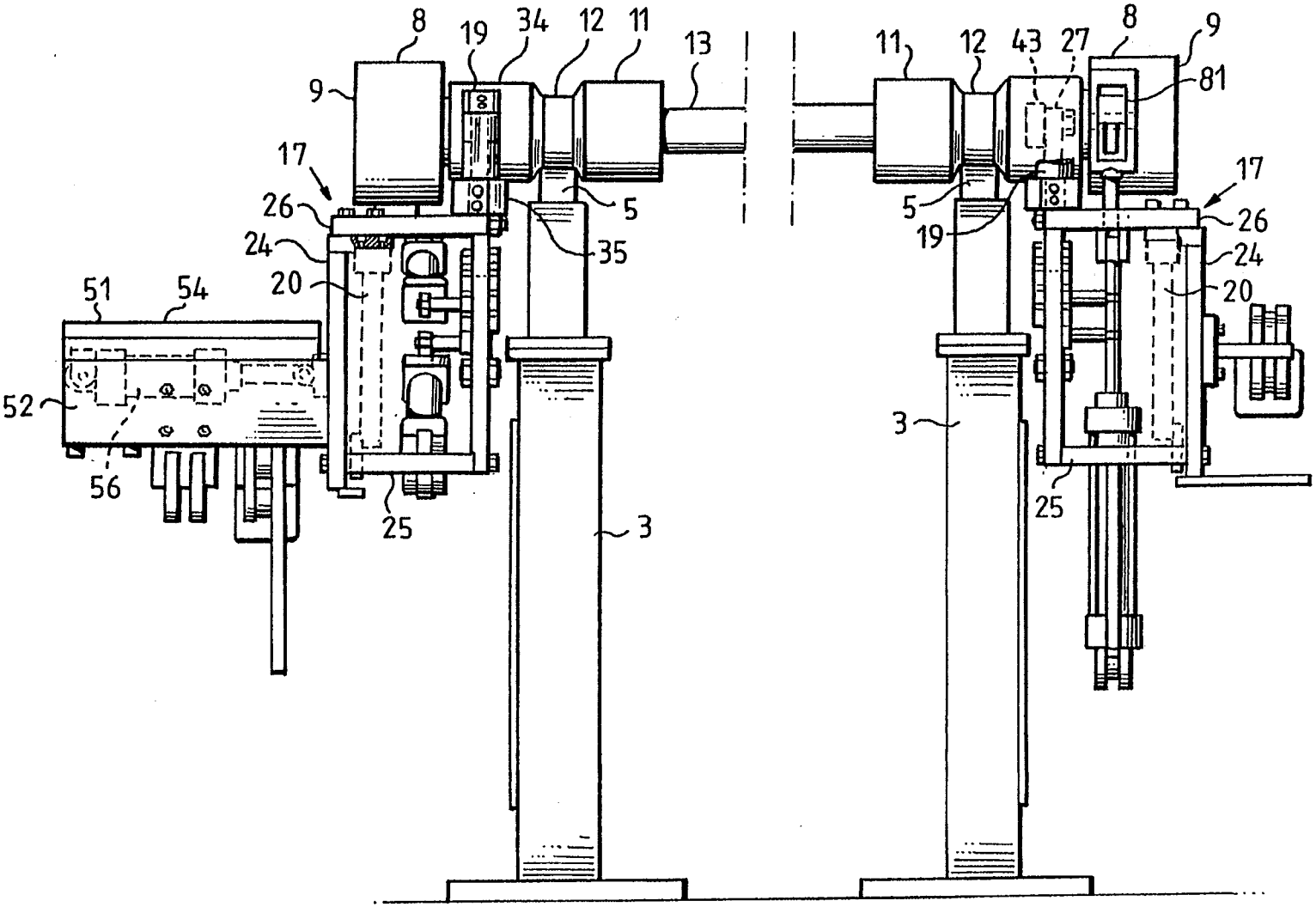
FIG. 5 is a cross-sectional view of the stand of the drum reel-up within the position for the secondary system according to FIG. 4.
Figure 6:
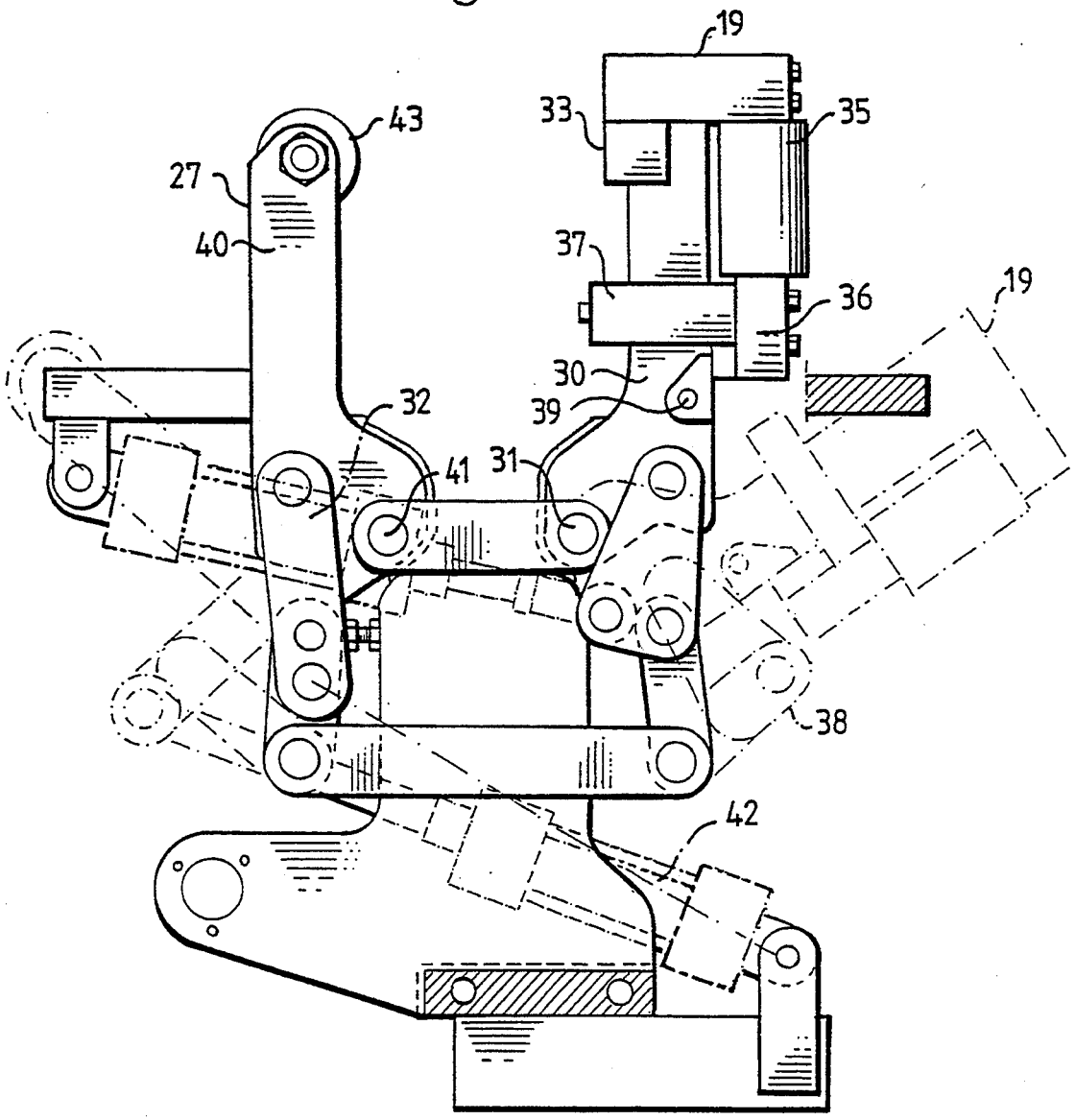
FIG. 6 is a further side view of parts of the secondary system showing the positioning and press devices in more detail.

Besides said press devices 19, the linear secondary system also includes two positioning devices 27 (see FIGS. 4–6). The press device 19 and positioning device 27 of each secondary carriage 17 are located in the space 22 between the beam 20 and the stand 3. The press device 19 is pivotal between a lower, inoperative position in which it is free from contact with the reeling drum 7, and an upper, fixed, operative position in which it is in contact with the reeling drum 7. The press device 19 includes an arm 30 (see FIG. 6) which is pivotally journalled on the secondary carriage 17 by means of a horizontal bearing pin 31 lying parallel with the central axis of the reeling drum 7. Pivoting between said two positions is effected with the aid of a hydraulic or pneumantic cylinder 32 mounted to the secondary carriage 17 and connected to the arm 30 via a knee point 38. The arm 30 carries a press head 33 with a pressing surface directed vertically in the operative position of the press device 19 and arranged to cooperate with an axially outer part 34, in relation to the groove 12, of the bearing housing 11 of the reeling drum 7. The press device 19 also supports a load cell 35 on which the press head 33 is rigidly mounted and which in turn is mounted to a connecting element 36 pivotally journalled on the arm 30 with the aid of a horizontal pin 39. The load cell 35 has an overload protection device 37 mounted to the arm 30 and operating on the inside of the connecting element 36 of the load cell 35. A force acting on the press surface of the press head 33 is transmitted to the load cell 35 which is subjected to a bending moment which is directly proportional to said force. The magnitude of this force is determined by the cylinder 18 of the secondary carriage 17 and thus by the position of the secondary carriage in relation to the central axis of the surface winding drum 4 or the nip maintained between the surface winding drum 4 and the paper reel 6 being produced. The overload protection device 37 is released when the load cell 35 is subjected to a predetermined maximum force and the load cell is then automatically returned to its functional position by a built-in spring device.

Said positioning device 27 (see FIGS. 4–6) is turnable between a lower, inoperative position in which it is free from contact with the reeling drum 7, and an upper, fixed, operative position in which it is in contact with the reeling drum 7. The positioning device includes an arm 40 which is pivotally journalled on the secondary carriage 17 by means of a horizontal bearing pin 41 lying parallel with the central axis of the reeling drum 7. Pivoting between said two positions is effected with the aid of a hydraulic or pneumatic cylinder 42 mounted to the secondary carriage 17. The arm 40 carries a support roll 43 arranged to cooperate with the outer part 34 of the bearing housing 11 of the reeling drum 7. The positioning device 27 is intended to be turned up to its fixed, operative position when a reeling drum 7 is in contact with the press device 19 and when the reeling drum 7 is to be fixed against the press device 19 to define a specific position of the reeling drum in relation to the secondary carriage 17, among other things. The positioning devices 27 are also turned up to fixed, operative position when a full reel of paper 6 is to be moved away from the surface winding drum 4, and thereby function as carriers.

The secondary system is combined with a drive means 50 for central driving of the reeling drum 7. The central drive means 50 is mounted to one of the secondary carriages 17 in order to be moved together with this in a unitary linear movement parallel to the rails 5. The central drive means 50 is also movable in a direction which is perpendicular to this linear movement described by the secondary carriage 17 and central drive means 50 together, and thus in a direction parallel to the reeling drum 7. For this purpose the central drive means 50 is mounted on a sledge 51 (see FIGS. 2 and 5) supported by brackets 52, said brackets being secured to the outer, vertical side plate 24 of the secondary carriage 17, and extending parallel with each other from the outer side thereof. The sledge 51 is journalled on the brackets by means of linear journalling elements 53 including roller bearings. The sledge 51 comprises a horizontal table 54 and, secured to it, a support element 55 directed verticallay downwards therefrom and located close to the outer side plate 24 of the secondary carriage 17. A pneumatic or hydraulic cylinder 56 (see FIG. 2) is placed below the sledge 51, between the brackets 52, and is attached by one end to the outer side plate 24 of the secondary carriage 17 and by the other end to the lower side of the table 54. By means of this cylinder 56 the sledge 51 and the central drive means 50 joined thereto, are moved in a direction of movement determined by the journalling elements 53 and brackets 52 which is parallel with the reeling drum 7 and perpendicular to the direction of movement of the secondary carriage 17.

The central drive means 50 also includes a power transmission means 57 having a motor 58 rigidly mounted to the vertical support element 55 of the sledge 51, its drive shaft 59 being vertically directed and extending through an opening in the table 54. The arrangement of the motor 58 described enables the centre of gravity of the motor to be located near the beam 20 so that the secondary carriage 17 is subjected to the least possible load torque. The drive shaft 59 of the motor 58 is connected to a mitre-wheel gear 60 disposed on the upper surface of the table 54 and provided with a grooved pulley 61 on its horizontal output shaft, to drive a tooth belt 62. The power transmission means 57 also includes a horizontal shaft 63, rotatably journalled in a bearing housing 64 supported by an upright 65. On the outer end of the shaft 63 is a grooved pulley 66, driven by said tooth belt 62, while on the inner end of the shaft 63 is a coupling device 67 with an external toothed rim 68 and a cylindrical central recess 69 (FIG. 7) surrounded by the toothed rim 68. The upright 65 is pivotally journalled at the table by journalling pins 70 forming a horizontal axis of rotation located parallel to the shaft 63 carrying the coupling device 67. The upright 65 has an attachment plate 71 protruding from one side thereof substantially on a level with the axis of rotation of the upright 65. The attachment plate 71 is provided with holes for receiving two bolts 72 without friction. The bolts 72 are screwed vertically into the table 54 and secured thereto by nuts 73. The position of the attachment plate 71 above the table 54 and the position of the centre line of the shaft 63, unaffected by external forces, are adjusted by means of intermediate nuts 74 acting against the lower side of the attachment plate 71. On the upper side of the attachment plate 71, bolts 72 support springs 75 the tension of which is adjusted by nuts 76. By means of the spring joint described, the shaft 63 provided with the coupling device 67 is resiliently connected to the table 54 so that the shaft 63 receives a certain freedom of parallel movement against the spring force under the influence of external forces arising during operation, the axis of rotation of this parallel movement being defined by the bearing pins 70. To facilitate connection of the two coupling devices 9 and 67 the facing surfaces of the teeth coming into contact with each other are rounded or bevelled. Similarly the free edge of the hub 77 is bevelled to facilitate insertion into the central recess 69 of the coupling device 67.

A tooth belt 78 (see FIG. 2) extends horizontally around two rollers 79 journalled in the stand 3 below the secondary carriage 17. One of the rollers 79 is connected to an absolute angle transducer 83. The tooth belt 78 and secondary carriage 17 are connected by means of a rigid connecting element 80 so that any linear movement of the secondary carriage 17 in either direction will result in exactly corresponding movement of the tooth belt 78. This movement is sensed by said absolute angle transducer and a signal is generated to indicate the position of the secondary carriage in relation to the surface winding drum 4, said position being a measurement of the size of the paper reel 6.

On the side of each secondary carriage 17 facing away from the surface winding drum 4 is a fork 81 which is turnable to a waiting position when a reeling drum 7 with its paper reel 6 is pushed away from the surface winding drum 4 with the aid of the secondary carriages 17 and their positioning means 27. The forks 81 are rotated and are locked when the secondary carriages 17 reach their end positions. The central drive means 50 can then be disconnected from the reeling drum 7 which, together with the paper reel 6, is rolled further to an end station with the aid of the fork 81, rotation of the paper reel 6 being retarded by a brake 82 acting on the braking drum 8 of the reeling drum 7.

The load cell 35 of each press device 19 registers the linear pressure and emits a measured value signal to a central unit for comparison with a set value and, in the event of an impermissible difference between these values, the central unit is arranged to emit a signal to activate the activators 18 for movement of the secondary carriages 17 until the predetermined linear pressure is again registered.

Instead of a surface winding drum to drive the paper reel by means of surface friction, an endless surface winding belt may be used, running over two rollers, for instance, one of which is driving.

That which is claimed is:

1. A reel-up in a paper machine in which paper is manufactured in a continuous web and reeled onto a reeling drum in the reel-up to produce a paper reel, each end portion of the reeling drum being provided with a bearing housing and a braking drum with a coupling device, said reel-up comprising a stand; a driven surface winding means rotatably journalled in the stand for advancing the continuous web over said surface winding means in surface-to-surface contact with the paper reel and thereby defining a nip between said surface winding means and the paper reel; two parallel rails mounted in the stand to support the reeling drum at said bearing housings; a secondary system movable linearly along the rails and provided in the vicinity of each rail with a linearly movable secondary body; actuators mounted on the stand for synchronous movement of the secondary bodies; press devices disposed on the secondary bodies to press against the bearing housings of the reeling drum to maintain a predetermined linear pressure in the nip between the surface winding means and the paper reel as the diameter of the paper reel increases during winding; drive means for central driving of the reeling drum, said central drive means comprising a rotating coupling device for coaxial connection to one of the coupling devices of the reeling drum during its rotation, said central drive means being mounted on one of the secondary bodies to be moved together with the secondary body; said secondary bodies having positioning means to abut in operative position against the bearing housings of said reeling drum on the side facing the surface winding means in order, together with the press devices, to fix the reeling drum so that its axis of rotation coincides with the axis of rotation of the coupling device of said central drive means; wherein said central drive means is axially movable on said secondary body in relation to the axis of said reeling drum in order, when said two axes of rotation coincide during operation, to bring the coupling device of said central drive means into engagement with the opposite coupling device of said reeling drum.

2. A reel-up in a paper machine in which paper is manufactured in a continuous web and reeled onto a reeling drum in the reel-up to produce a paper reel, each end portion of the reeling drum being provided with a bearing housing and a braking drum with a coupling device, said reel-up comprising a stand; a driven surface winding means rotatably journalled in the stand for advancing the continuous web over said surface winding means in surface-to-surface contact with the paper reel and thereby defining a nip between said surface winding means and the paper reel; two parallel rails mounted in the stand to support the reeling drum at said bearing housings; a secondary system movable linearly along the rails and provided in the vicinity of each rail with a linearly movable secondary body; actuators mounted on the stand for synchronous movement of the secondary bodies; press devices disposed on the secondary bodies to press against the bearing housings of the reeling drum to maintain a predetermined linear pressure in the nip between the surface winding means and the paper reel as the diameter of the paper reel increases during winding; drive means for central driving of the reeling drum, said central drive means comprising a rotating coupling device for coaxial connection to one of the coupling devices of the reeling drum during its rotation, said central drive means being mounted on one of the secondary bodies to be moved together with the secondary body; said secondary bodies having positioning means to abut in operative position against the bearing housings of said reeling drum on the side facing the surface winding means in order, together with the press devices, to fix the reeling drum so that its axis of rotation coincides with the axis of rotation of the coupling device of said central drive means; wherein said central drive means is axially movable on said secondary body in relation to the axis of said reeling drum in order, when said two axes of rotation coincide during operation, to bring the coupling device of said central drive means into engagement with the opposite coupling device of said reeling drum; and wherein each secondary body consists of a secondary carriage supported by a horizontal beam spaced from said rail and secured to the stand carrying the rail.

3. A reel-up as recited in claim 2 wherein the position of said secondary carriage in relation to said surface winding means is sensed by an absolute angle tranducer.

4. A reel-up as recited in claim 2 wherein each press device comprises a load cell which registers said linear pressure and emits a measured value signal to a central unit for comparison with a set value and, in the event of an impermissible difference between these values, the central unit is arranged to emit a signal to activate said actuators for movement of said secondary carriages until the predetermined linear pressure is again registered.

5. A reel-up as recited in claim 4 wherein said load cell is provided with an overload protection means comprising spring means for automatic return of the load cell to its functional position after releasing when a maximum value of the force provided by the press devices has been exceeded.

6. A reel-up in a paper machine in which paper is manufactured in a continuous web and reeled onto a reeling drum in the reel-up to produce a paper reel, each end portion of the reeling drum being provided with a bearing housing and a braking drum with a coupling device, said reel-up comprising a stand; a driven surface winding means rotatably journalled in the stand for advancing the continuous web over said surface winding means in surface-to-surface contact with the paper reel and thereby defining a nip between said surface winding means and the paper reel; two parallel rails mounted in the stand to support the reeling drum at said bearing housings; a secondary system movable linearly along the rails and provided in the vicinity of each rail with a linearly movable secondary body; actuators mounted on the stand for synchronous movement of the secondary bodies; press devices disposed on the secondary bodies to press against the bearing housings of the reeling drum to maintain a predetermined linear pressure in the nip between the surface winding means and the paper reel as the diameter of the paper reel increases during winding; drive means for central driving of the reeling drum, said central drive means comprising a rotating coupling device for coaxial connection to one of the coupling devices of the reeling drum during its rotation, said central drive means being mounted on one of the secondary bodies to be moved together with the secondary body; said secondary bodies having positioning means to abut in operative position against the bearing housings of said reeling drum on the side facing the surface winding means in order, together with the press devices, to fix the reeling drum so that its axis of rotation coincides with the axis of rotation of the coupling device of said central drive means; wherein said central drive means is axially movable on said secondary body in relation to the axis of said reeling drum in order, when said two axes of rotation coincide during operation, to bring the coupling device of said central drive means into engagement with the opposite coupling device of said reeling drum; and wherein each secondary body consists of a secondary carriage supported by a horizontal beam spaced from said rail and secured to the stand carrying the rail, said secondary carriage having an outer side plate and a pair of brackets secured to the outside of said side plate, and wherein said central drive means includes a sledge journalled on the brackets by means of an actuator in order to achieve said engagement between the coupling devices.

7. A reel-up as recited in claim 6 wherein said central drive means comprises a power transmission having a motor supported by said sledge and a horizontal shaft driven by said motor, said horizontal shaft being perpendicular to said rail extending through a bearing housing and supporting said coupling device.

8. A reel-up as recited in claim 7 wherein said sledge comprises a horizontal table carrying on its upper surface the bearing housing of said shaft via an upright and on its lower side carrying said motor via a vertical support element secured to the table in the vicinity of the outer side plate of said secondary carriage.

9. A reel-up as recited in claim 8 wherein the drive shaft of said motor extends vertically up through an opening in said table and drives said horizontal shaft via a mitre-wheel gear and belt and pulley means.

* * * * *